United States Patent [19]

Weir

[11] Patent Number: 4,901,377

[45] Date of Patent: Feb. 20, 1990

[54] TOILET BOWL AUTOMATIC FLOW SHUT OFF AND WATER SAVER DEVICE

[76] Inventor: Richard L. Weir, 2217 Grant Ave., Dayton, Ohio 45406

[21] Appl. No.: 264,903

[22] Filed: Oct. 31, 1988

[51] Int. Cl.[4] ..... E03D 1/00; E03D 1/22

[52] U.S. Cl. ..... 4/415; 137/400

[58] Field of Search ..... 4/366, 415, 427, 346, 4/367, 407; 137/434, 435, 400, 401, 403, 404

[56] References Cited

U.S. PATENT DOCUMENTS

| | | | |
|---|---|---|---|
| 2,841,169 | 7/1958 | Martin et al. | 137/400 |
| 3,151,338 | 10/1964 | Nunnery | 4/407 X |
| 3,574,867 | 4/1971 | Biniores | 137/400 |

*Primary Examiner*—Charles E. Phillips

[57] ABSTRACT

The toilet tank automatic water flow shut off for stuck or defective flow valves and water saver device depicted herein consists of a simple mechanism for installation in a water tank of a conventional water flush toilet, underneath the ball float, to provide time delay action, for water shut off. To provide time delay action, so the device will not operate during normal flushing operations, a small hole is provided toward the bottom of a small water tank with an open top, that is located on the top of a sealed spring bellows assembly, that is restricted in vertical movement by the weight of the water in the small water tank. An exit for the air within the bellows assembly is provided by a small tube connected to the bottom of the air pocket within the bellows at one end, and extending upwardly to the air pocket above the top level of water in the toilet water tank. When the toilet water tank is essentially empty for an extended period of time, as when the flush valve is stuck open or becomes ruptured, the water drains out of a small orifice toward the bottom of the small water tank and the spring bellows assembly then exerts upward pressure to force the small water tank upward against the ball float, forcing the ball float upward and shutting off the water flow into the toilet water tank. When the toilet tank flush valve is fixed or reset to the closed position, the automatic flow shut off mechanism is re-activated by manually depressing the ball float until the toilet water tank is full. The device protects against excessive water loss from stuck toilet valves as well as saving water at each normal flush by the water retained in the small tank. The alternate embodiment employs the same basic concepts with different components and arrangement.

1 Claim, 7 Drawing Sheets

TOILET BOWL AUTOMATIC FLOW SHUT OFF AND WATER SAVER DEVICE

GENERAL

Figure 1:
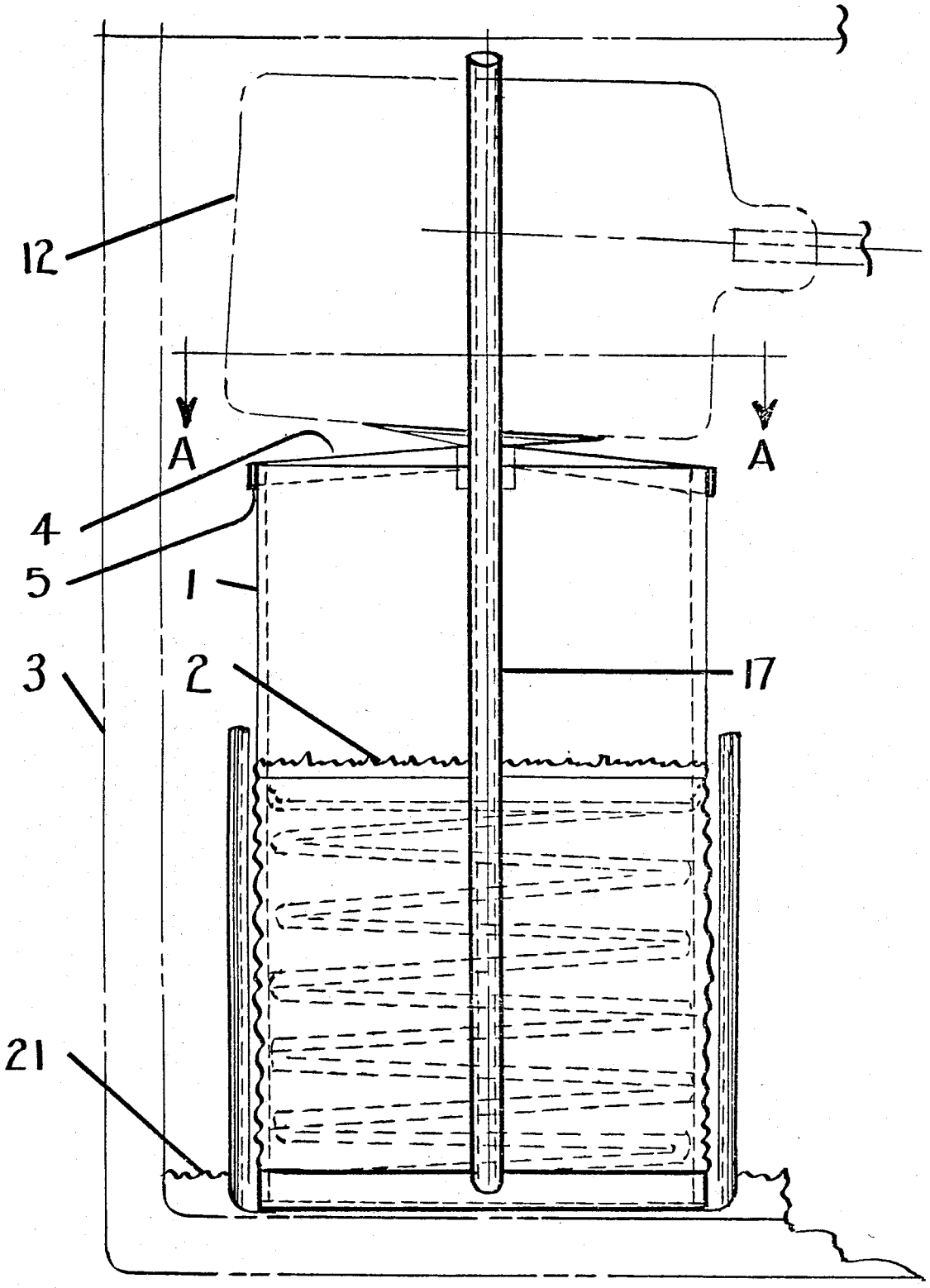
Figure 2:
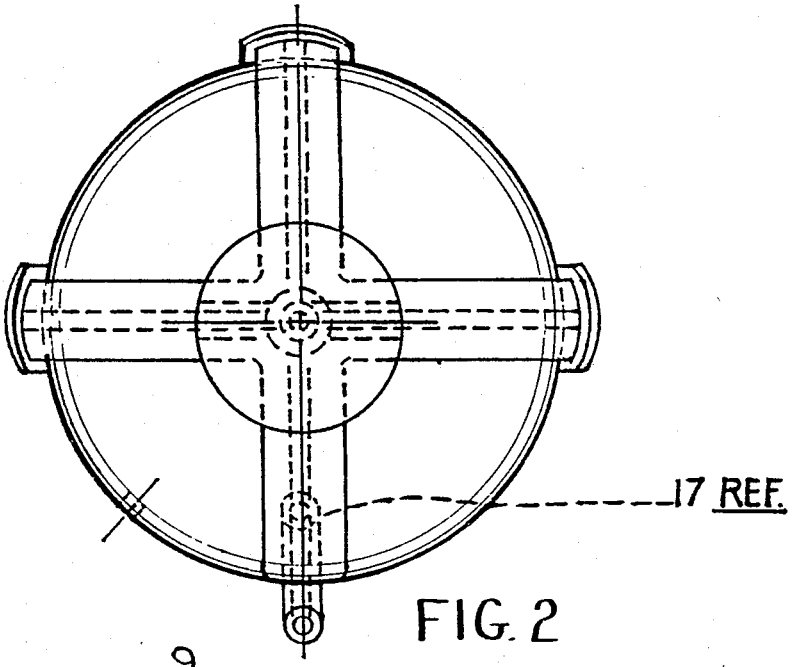
Figure 3:
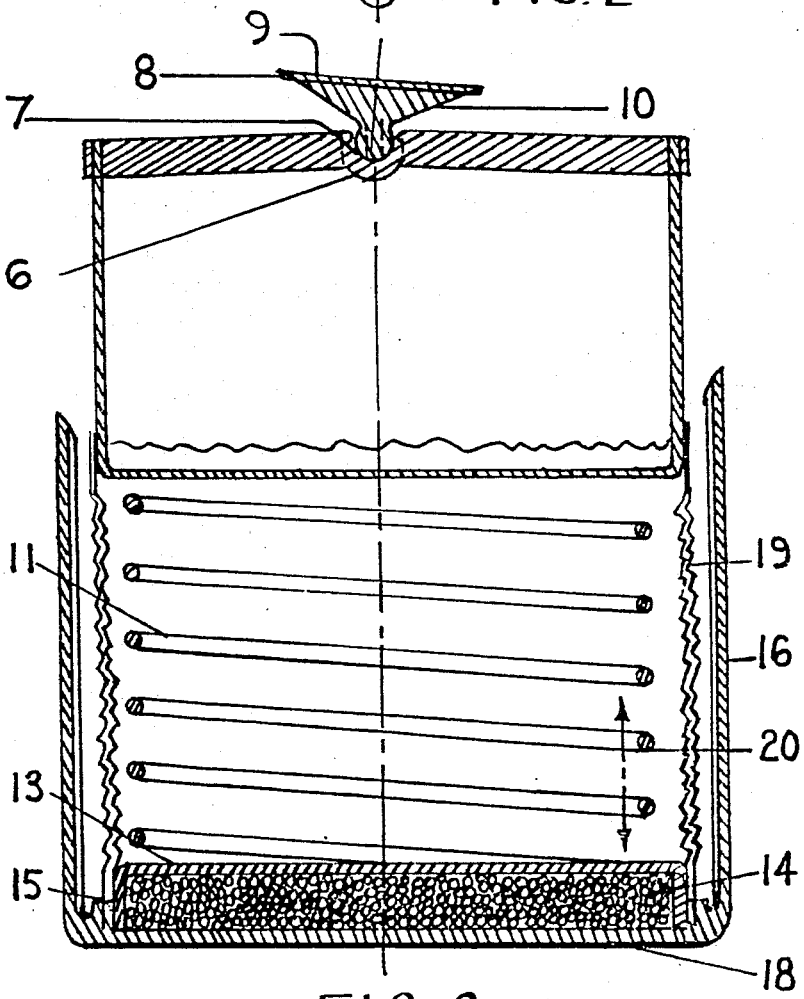
Figure 4:
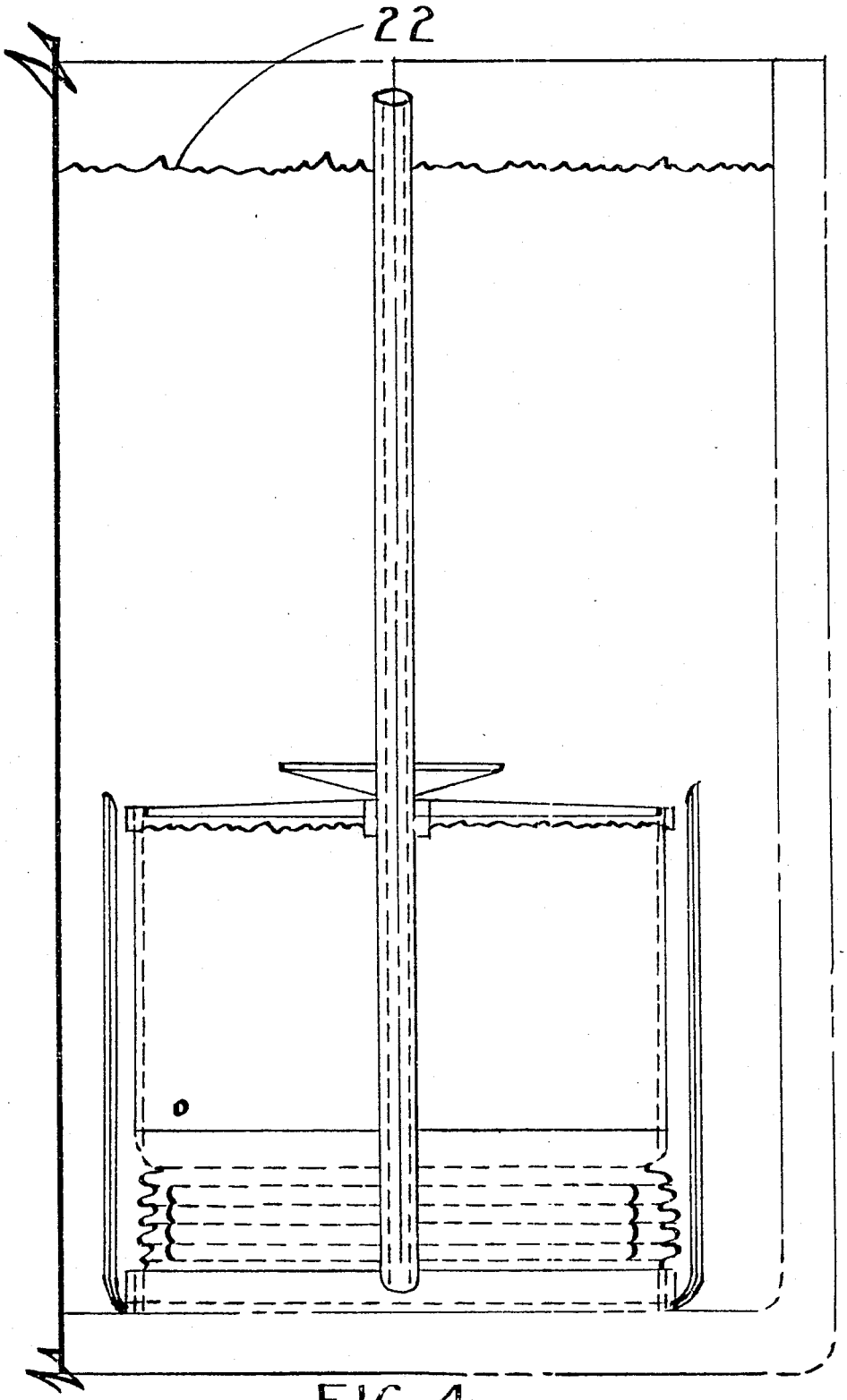
Figure 5:
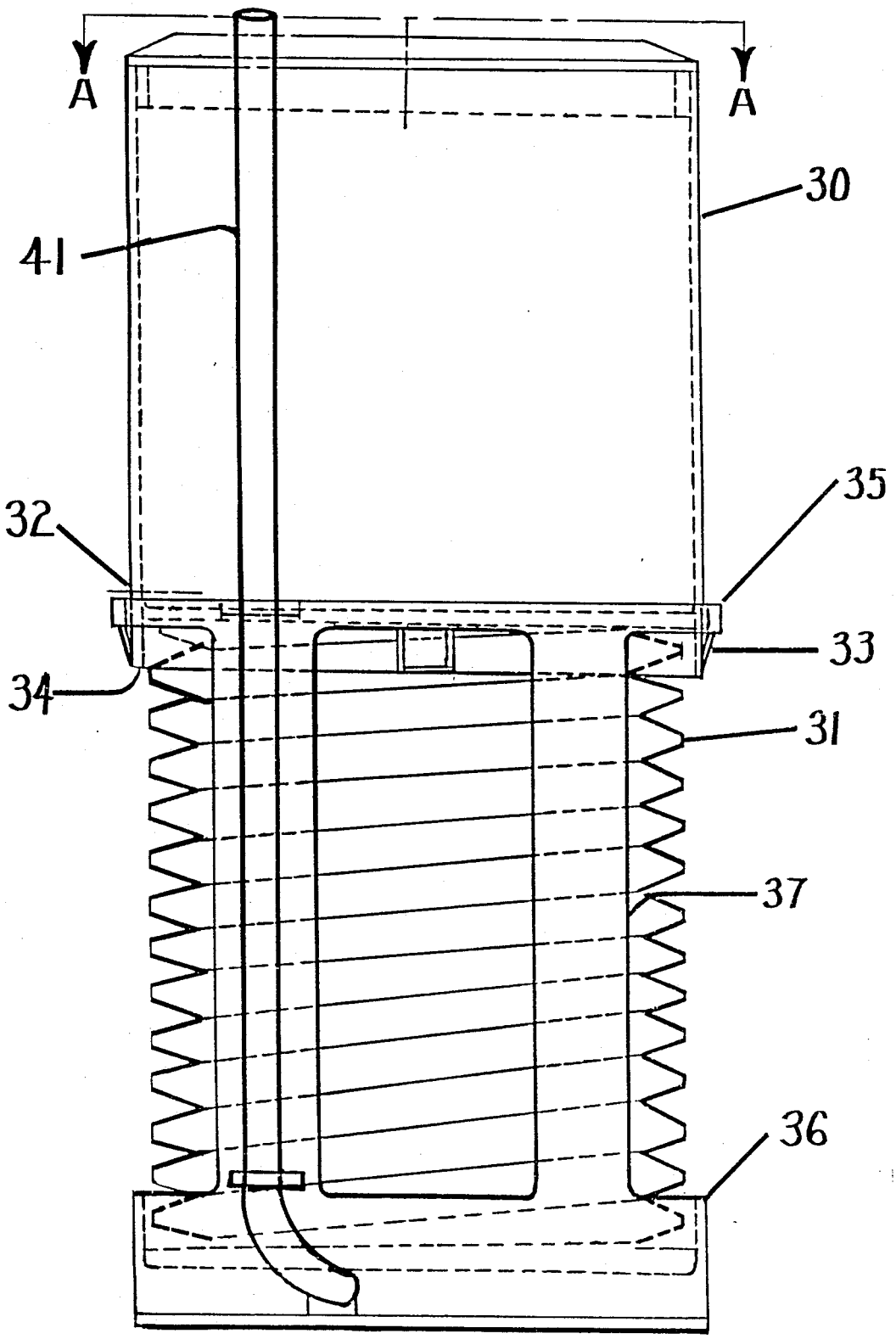
Figure 6:
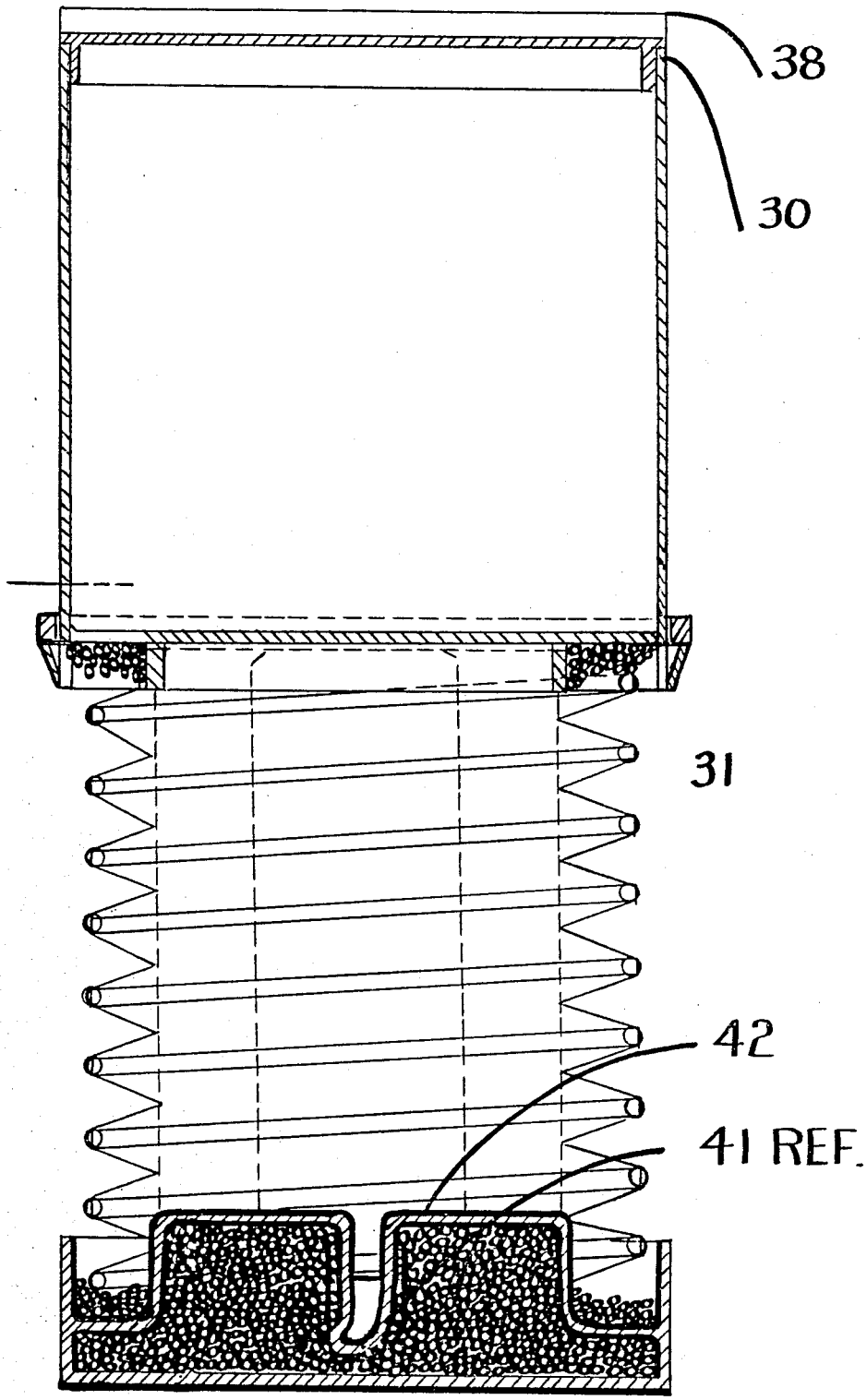
Figure 7:
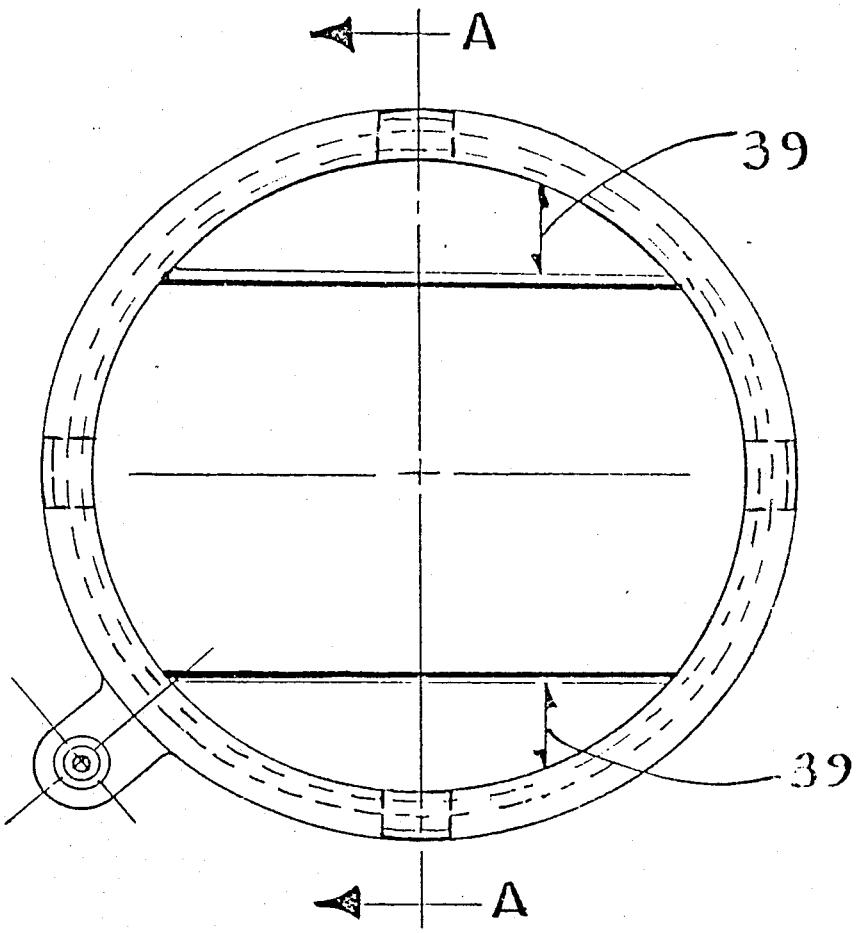
Figure 7A:
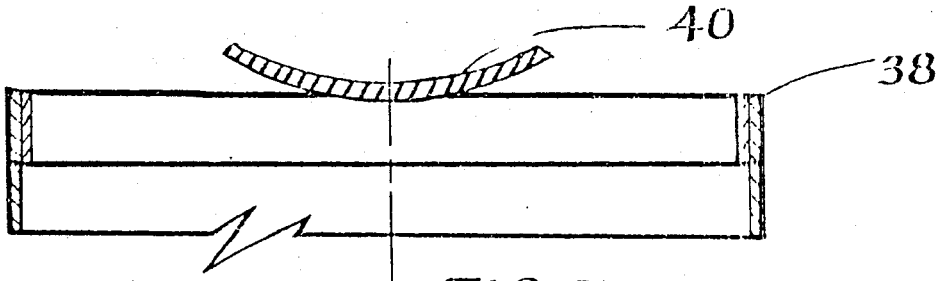
Figure 7B:
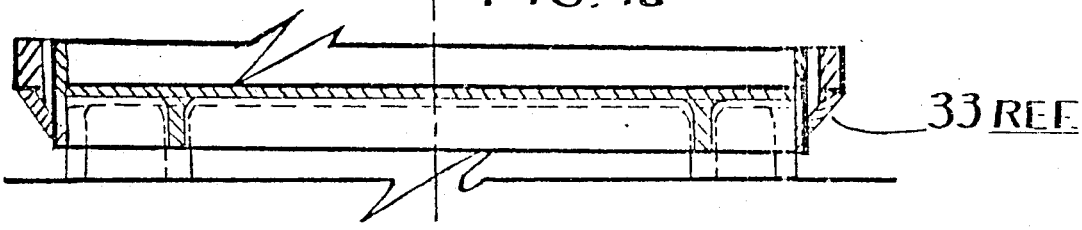
Figure 8:
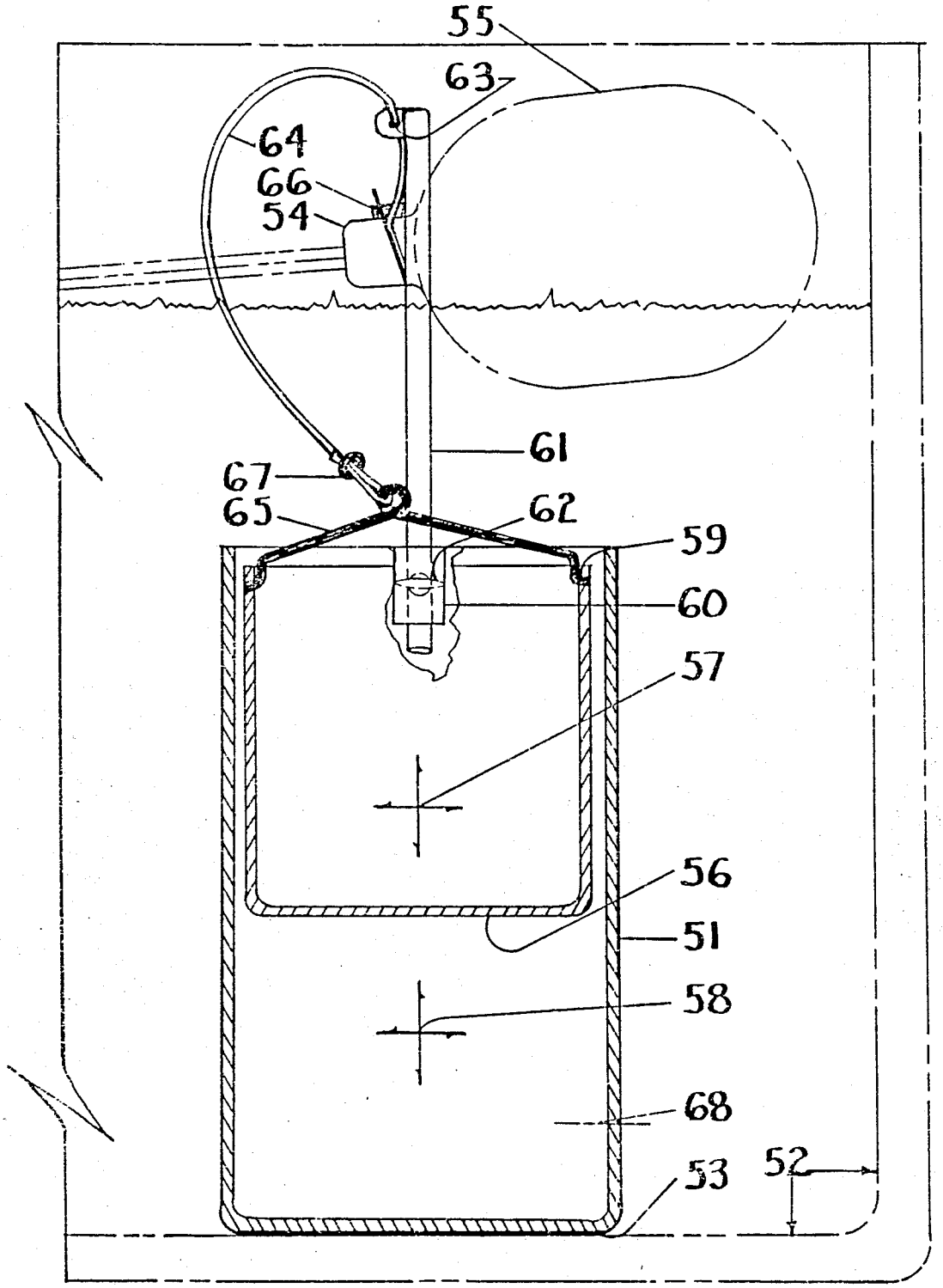

In most conventional tank type water flush toilet installations a ball float, with rod attached, is used to control on-off pressurized water flow into the water tank thru a control valve attached to the end of the rod. In such installations a water flush valve in the bottom of the tank often sticks open allowing water to flow continuously thru the tank wasting large amounts of water. The Weir Automatic Water Flow Shut Off Mechanism has been conceived, designed and developed by the undersigned to correct this deficiency. To achieve the desired result it appears obvious that some type of a delay mechanism must be incorporated in the system to sense when the water is running thru the tank for an extended period of time in excess of that required for normal flushing operations. One method of accomplishing the purpose is to use a small tank, with an open top, within the main water tank, with a small exit orifice near the bottom of the tank, to drain slowly, so that a time delayed motion may be activated when the small tank is partially or completely empty, to close the water entrance valve to the main tank; shutting off water flow thru the main tank. A preferred embodiment of such a mechanism is described as follows.

IN THE DRAWINGS

FIG. I is a side view of the mechanism in extended position (holding the ball float up and the water entrance valve closed when the tank is essentially empty).

FIG. II is a top view of the mechanism.

FIG. III is a vertical cross section view of the mechanism in FIG. I, taken along the center line A—A.

FIG. IV is a side view of the mechanism in collapsed position.

FIG. V is an assembly side view of the mechanism.

FIG. VI is a vertical cross section view taken along the center line A—A of the assembly view (FIG. V).

FIG. VII is a top view of the assembly with cross section view A—A depicting specific area details.

FIG. VIII is a cross section view of the mechanism as installed in a conventional water tank.

In FIG. I, 1 is a round cylindrical tank with thin side walls, a closed bottom and an open top. it has a small hole 2 thru the side wall near the bottom of the tank to allow exit of water from the tank over a period of time. This occurs when the toilet assembly water tank 3 (shown in phantom) is essentially empty of water, as when a flush valve is stuck open. At the top of cylindrical tank 1, is spider like four legged tank brace and lower ball joint unit 4, which contains grooves 5 in the bottom faces near the outer edges of the legs. These grooves fit snugly over the top edge of tank 1, maintaining the relative positions of tank 1 and spider assembly 4. In the central section of spider assembly 4, on the upper face, is ball joint recess 6 (FIG. III) in which ball section 7, of float carrier 8 is retained. Float carrier 8 has round flat plate 9 on its upper extremity with four triangular rib section 10 underneath which connect it to the centrically located ball section 7. The carrier assembly is thus self adjusting to the bottom of ball float 12.

Nesting below tank 1, is coil spring 11, which in its extended position holds ball float 12 (FIG. I) upwardly and closes water tank inlet valve (not shown). Coil spring 11 rests on the top of base weight retainer 13 (FIG. III) which is an inverted round shallow cylinder with concrete or other weight pellets 14, inside. Cylindrical base cap 15, surrounds base weight retainor 13, on the bottom face and around the side and holds pellet weights inside. Extending upwardly from base cap 15 are three guide arms 16, which, with air tube exitor 17 (FIGS. I & III) retain the mechanism from shifting laterally. Adhesive pad 18 is attached to the bottom of base cap 15 to hold the assembly in place under ball float 12.

Flexible diaphragm 19, (FIG. III) is a tin tube like water proof membrane and is sealed at its upper extremity around the bottom outside edge of tank 1, and at its lower extremity around the top outer edge of inverted base weight retainor 13. It provides an air chamber 20, between tank 1 and retainor 13, when spring 11 is extended.

Air tube exitor 17 is a round tube like structure that interconnects with the air chamber 20 at its lower extremity, thru the wall and upper face plate of retainor 13, and to the air space above the water level within the toilet tank 3. Wavely line 21 (FIG. I) indicates the water level in an almost empty toilet water tank 3, as when a flush valve is stuck open. In this case water in tank 1, in a predetermined period of time, determined by the size of hole 2, has drained from tank 1. Spring 11, with very little water weight above, has pushed empty tank 1, cap assembly and float carrier and ball float upward shutting off water inlet valve and water flow into tank 3. When ball float is manually depressed (after flush valve repair, or release if stuck) tank refills to normal level 22 (FIG. IV); tank 1 is also filled and depresses spring, as air within the chamber is expelled to the air space above the water thru air tube 17. Assembly remains under ball float as shown in FIG. IV until next float valve problem. As very little water in tank 1 will normally be expelled in flushing operation this water will be saved in tank 1 with each flush of the toilet.

A revised design, depicting details of the preferred embodyment for improved, less costly production is described as follows:

In FIG. V, 30 is a cylindrical actuator tank that normally is full of water and holds the spring bellows assembly 31 compressed beneath the tank 30 as noted in the preferred embodyment. In the position shown herein tank 30 is empty, the water normally contained therein having drained out the small hole 32 in the side of tank 30, near the bottom thereof. Four flexible stops 33, are incorporated in the lower skirt 34, of tank 30, spaced equally around the circumference. Three stops may be used in lieu of four, or even two stops, equally spaced around the skirt, to save costs. These stops fold back into circular skirt 34 when tank 30 is originally installed within the top ring 35 of bellows guide and retainor 36, which has ribs 37, connecting the base section to the top ring 35. Flexible stops 33 are shown in more detail in the lower view of cross section A—A (FIG. VII). Tank 30 has cylindrical cap 38 (FIG. VII) inserted tightly there therein. Cap 38, has void areas 39, on both sides of curved float carrier section 40, allowing water from the main toilet water tank (not shown) to enter tank 30, when ball float (not shown) is depressed downward, forcing bellows to collapse, expelling air thru tube 41, FIG. V, to air space above the water level in the main toilet tank. The water then retained in tank 30, holds the bellows in collapsed position until water is drained from tank 30, over an extended period of time, determined by the size of the small hole, when the flush valve mal-functions. Spring loaded bellows then force the ball float upward, shutting off water flow into the toilet water tank. When the ball float is manually depressed the main toilet tank and the small actuator tank fill up, holding the bellows in depressed position, until malfunction of the flush valve occurs again. Base assembly 42, (FIG. V) is an inverted cylindrical section with a channel surrounding the upwardly protruding central cylindrical section to accept the lower end of the sealed bellows assembly, for sealing same to the base 42. Flat circular seal 43, has adhesive material on the bottom surface, as well as the top, for attachment of the base to the main water tank 44. Cement fill 45, is used to fill the internal void in base 42, to hold the device down, under the ball float in the main water tank..

An alternate embodiment of the basic concept of using restricted flow from a tank within the main water tank of a conventional water flush type toilet is depicted in FIG. III and the following description.

In FIG. VIII, 51 is a round cylinder of plastic (or other material) with an open top and closed bottom. It is positioned on the interior bottom of the toilet water tank 52, with adhesive pad 53, with the neck 54, of the main water tank actuator ball float 55, positioned approximately over the center of the cylinder 51. Positioned within cylinder 51, is light weight actuating cylinder 56, with an open top and closed bottom, which is full of water 57, and floats on water 58 within cylinder 1. Space is provided between the outer surface of light weight actuating cylinder 56, and the inside surface of cylinder 51, to allow free passage of water when the cylinders are filling. Stop pin 59, extends thru the wall of cylinder tank 51, and over the top of the side wall of actuating cylinder 56, and prevents actuating cylindrical tank 56, from floating up out of cylinder 51. Attached to the outside of cylinder 51, at the top edge, is rod retaining cylindrical knob 60, which has a round hole thru the center, thru which extension rod 61, is inserted, and held in position by threaded thumb nut 62, which is installed in a threaded hole in the side wall of cylindrical knob 60. Round extension rod 61, is bent at a 90 degree angle at the top and extends across the top of cylinder 51, slightly past the center of cylinder 51. Hole 63, extends thru rod 11, and is of sufficient size to allow free passage of flexible cord 64.

Attached within the top of cylindrical tank 56, is spring wire connector 65. The ends of spring wire connector 65 are held by spring tension in holes on opposite sides of cylinder 56, near the top. Plastic cord 64, at its upper extremity, extends around neck 54, of ball float 55, and is held in place by clamp cord 66. The lower extremity of plastic cord 64 is attached to spring wire 65, by slide clamp 67. A small hole 68, is provided in the wall of cylinder 51, near the bottom, to control the pre-determined time required for cylinder 51, to empty into the main toilet water tank 52, when the main water tank 52, is nearly empty for a continuing period of time. This, in turn, allows water filled cylinder 56, to descend within cylinder 51, and pull lower end of the plastic cord 64, downward. Hole 63, in rod 61, allows free passage of cord 64, and the upper end of cord 64, which surrounds and is attached to the neck of ball float 63, pulls ball float 63 upward and shuts entering water control valve (not shown), stopping water flow thru and out of the water tank 52. When the defective flush valve is unstuck, replaced or repaired, and the tank is to be refilled, the water tank valve actuator ball float is depressed manually and the water area in the main tank, as well as the water area in cylinder 51, is refilled. The space between the outer wall of the light weightactuating cylinder 56, and the inner wall of cylinder 51 allows this to occur. In normal flushing operations the water in the lower section of cylinder 51, is lowered only a small amount until main water tank 52, is refilled and water lost thru hole 18 is replaced.

I claim:

1. A time delay device for use in a water flush toilet tank of a conventional toilet to automatically cut off water flow thru a lever arm float controlled inlet to the water tank when the flush valve mal-functions allowing water in the tank to continuously drain for an extended period of time, the time delay device consists of a relatively small actuator tank which has a small orifice therein near its bottom to restrict the flow a fluid out of said tank, said actuator tank being attached to said lever arm float by an attached mechanism, said actuator tank being seated on a sealed air entrained spring bellows device, which has one end of a tube attached to the sealed air section with the opposite end of said tube providing air exit to a level above the water in the tank, said bellows being seated on the bottom of the toilet tank and providing upward pressure on the actuator tank, which in turn provides upward pressure on the ball float via said attached mechanism; wherein, when the outlet valve mal-functions to allow water in the tank to flow out over an extended period of time, with the actuator tank below the normal full water level of the tank, the weight of water in said actuator tank will cause said bellows to compress as the lever arm float decends during the tank water level drop, however after a period of time longer than the normal water outlet time water in said actuator tank will begin to drain out of the small orifice until the weight of the water and actuator tank will no longer be sufficient to compress the bellows at which time the spring force of the bellows will move the empty actuator tank and attached float lever arm upwardly to close the tank inlet.

* * * * *